US012680777B2

(12) United States Patent
Kirk et al.

(10) Patent No.: US 12,680,777 B2
(45) Date of Patent: Jul. 14, 2026

(54) MUZZLE BRAKE ASSEMBLY

(71) Applicant: BAE SYSTEMS PLC, London (GB)

(72) Inventors: Matthew Kirk, Barrow-in-Furness (GB); Richard Peter Lewin, Barrow-in-Furness (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 19/102,514

(22) PCT Filed: Aug. 4, 2023

(86) PCT No.: PCT/GB2023/052074

§ 371 (c)(1),
(2) Date: Feb. 10, 2025

(87) PCT Pub. No.: WO2024/033618

PCT Pub. Date: Feb. 15, 2024

(65) Prior Publication Data

US 2026/0078975 A1 Mar. 19, 2026

(30) Foreign Application Priority Data

Aug. 10, 2022 (EP) ..... 22275106
Aug. 10, 2022 (GB) ..... 2211665

(51) Int. Cl.
*F41A 21/38* (2006.01)

(52) U.S. Cl.
CPC ..... *F41A 21/38* (2013.01)

(58) Field of Classification Search
CPC ..... F41A 21/38; F41A 21/28; F41A 21/32; F41A 21/325; F41A 21/34; F41A 21/36
USPC ..... 89/14.3
See application file for complete search history.

(56) References Cited

U.S. PATENT DOCUMENTS 1,327,897 A * 1/1920 Baldwin ..... F41A 5/20 89/14.05
1,380,358 A * 6/1921 Cooke ..... F41A 21/36 89/1.3
1,555,026 A * 9/1925 Rose ..... F41A 21/36 89/14.3

(Continued)

FOREIGN PATENT DOCUMENTS

FR 897759 A 3/1945
GB 572704 A 10/1945
WO WO2024033618 A1 2/2024

OTHER PUBLICATIONS

International Search Report and Written Opinion received for PCT/GB2023/052074. Mail date: Oct. 23, 2023. 9 pages.

(Continued)

*Primary Examiner* — John Cooper
(74) *Attorney, Agent, or Firm* — Arcane Law PLLC

(57) ABSTRACT

The present disclosure relates to a modular muzzle brake assembly for an artillery weapon or cannon. The modular muzzle brake assembly comprises a plurality of modules configured to be releasably coupled together to define a passage for a projectile such that, when the artillery weapon or cannon is fired, propellant gas urges the projectile to pass through the passage. The plurality of modules include a plurality of baffles configured to divert at least a portion of the propellant gas in the passage. The present disclosure also relates to a kit of parts for a modular muzzle brake assembly.

20 Claims, 8 Drawing Sheets

(56) References Cited

U.S. PATENT DOCUMENTS

| | | | | | |
|---|---|---|---|---|---|
| 2,444,910 | A * | 7/1948 | Barker | F41A 21/36 | 89/14.3 |
| 3,528,336 | A * | 9/1970 | Donner | F41A 21/32 | 89/14.3 |
| 4,203,347 | A * | 5/1980 | Pinson | F41A 1/08 | 89/1.816 |
| 5,036,747 | A * | 8/1991 | McClain, III | F41A 21/36 | 89/14.3 |
| 5,631,438 | A * | 5/1997 | Martel | F41A 21/36 | 89/14.3 |
| 10,054,383 | B2 * | 8/2018 | Davis | F41A 21/34 | |
| 11,187,485 | B2 * | 11/2021 | Albright | F41A 21/34 | |
| 2016/0209154 | A1 * | 7/2016 | Wilson | F41A 21/38 | |
| 2018/0306544 | A1 * | 10/2018 | White | F41A 21/30 | |
| 2020/0217607 | A1 * | 7/2020 | Albright | F41A 21/38 | |

OTHER PUBLICATIONS

Search Report under Section 17(5) received for GB Application No. 2211665.1, dated Feb. 1, 2023. 3 pages.
Extended European Search Report received for EP Application No. 22275106.7, dated Jan. 19, 2023. 6 pages.

* cited by examiner

MUZZLE BRAKE ASSEMBLY

FIELD

The present invention relates to a modular muzzle brake assembly for an artillery weapon or cannon. The present invention also relates to a kit of parts for a modular muzzle brake assembly.

BACKGROUND

Muzzle brakes are used to reduce the effects of recoil when a tubed weapon is fired. Muzzle brakes are configured to divert a portion of the propellant combustion gas venting from the barrel after a projectile has exited to reduce the recoil force on the barrel, and hence reduce stress on a support structure to which the barrel is attached. By diverting the gas, the forward momentum of the gas is reduced and the rearward momentum of the barrel is reduced by a corresponding amount. The greater the volume of gas and the greater the angle of diversion, the greater the recoil efficiency of the muzzle brake.

It has been found that the combustion gases venting from the barrel and entering the muzzle brake can cause significant wear to the muzzle brake. Therefore, a muzzle brake which is easier to repair and maintain is desirable.

SUMMARY

According to an aspect of the present invention, there is provided a modular muzzle brake assembly for an artillery weapon or cannon, the modular muzzle brake assembly comprising a plurality of modules configured to be releasably coupled together to define a passage for a projectile such that, when the artillery weapon or cannon is fired, propellant gas urges the projectile to pass through the passage, and wherein the plurality of modules include a plurality of baffles configured to divert at least a portion of the propellant gas in the passage.

In some embodiments, the muzzle brake assembly is for a medium or large calibre artillery weapon or cannon.

In some embodiments, the muzzle brake assembly is for an artillery weapon or cannon that has a calibre of at least 20 mm and, preferably, at least 76 mm.

As used herein the term "cannon" includes, for example, tank guns.

In some embodiments, the muzzle brake assembly is for an artillery weapon or cannon that is mounted to a support structure (e.g. a platform).

In some embodiments, the modular muzzle brake comprises at least one coupling member to couple the modules together, the modules being releasable from the at least one coupling member.

In some embodiments, the at least one coupling member comprises an elongate member and, preferably, comprises a tie rod.

In some embodiments, one or more of the baffles comprises a receiving portion configured to receive part of the coupling member.

In some embodiments, the modular muzzle brake comprises a plurality of coupling members and, preferably, wherein the plurality of coupling members are configured to be disposed about a central axis of the passage.

In some embodiments, a gap is provided between at least two baffles of the assembly such that at least a portion of the propellant gas in the passage can pass through the gap.

In some embodiments, the modular muzzle brake assembly comprises one or more spacers configured to space the at least two baffles apart and, preferably, the plurality of modules includes the one or more spacers.

In some embodiments, the or each spacer is tubular.

In some embodiments, the or each spacer is configured to receive a part of a respective coupling member.

In some embodiments, at least one of the baffles comprises first and second baffle members and, preferably, wherein the first and second baffle members are baffle plates.

In some embodiments, a space is disposed between the first and second baffle members.

In some embodiments, at least two of the baffles are interchangeable within the muzzle brake assembly.

In some embodiments, at least one of the baffles is configured to divert the propellant gas in a different manner to another one of the baffles.

In some embodiments, the length of the passage is adjustable by altering the number of modules of the modular muzzle brake assembly.

In some embodiments, the modular muzzle brake assembly further comprises a mounting portion configured to couple to a gun tube of the artillery weapon or cannon.

In some embodiments, the or each coupling member has one or more threaded portions. At least one threaded portion may be configured to engage with a threaded portion of a stop (for example, a nut). Alternatively, or additionally, at least one threaded portion may be configured to engage with a threaded portion of the mounting portion.

According to the present disclosure, there is also provided a weapon system comprising the modular muzzle brake assembly described herein. The weapon system may be, for example, a tank or artillery.

According to the present disclosure, there is also provided a kit of parts for a modular muzzle brake assembly for an artillery weapon or cannon, the kit of parts comprising a plurality of modules configured to be releasably coupled together to define a passage for a projectile such that, when the artillery weapon or cannon is fired, propellant gas urges the projectile to pass through the passage, and wherein the plurality of modules include a plurality of baffles configured to divert at least a portion of the propellant gas in the passage.

BRIEF DESCRIPTION OF THE FIGURES

Embodiments of the invention will now be described by way of example only with reference to the figures, in which.

DETAILED DESCRIPTION

Figure 1:
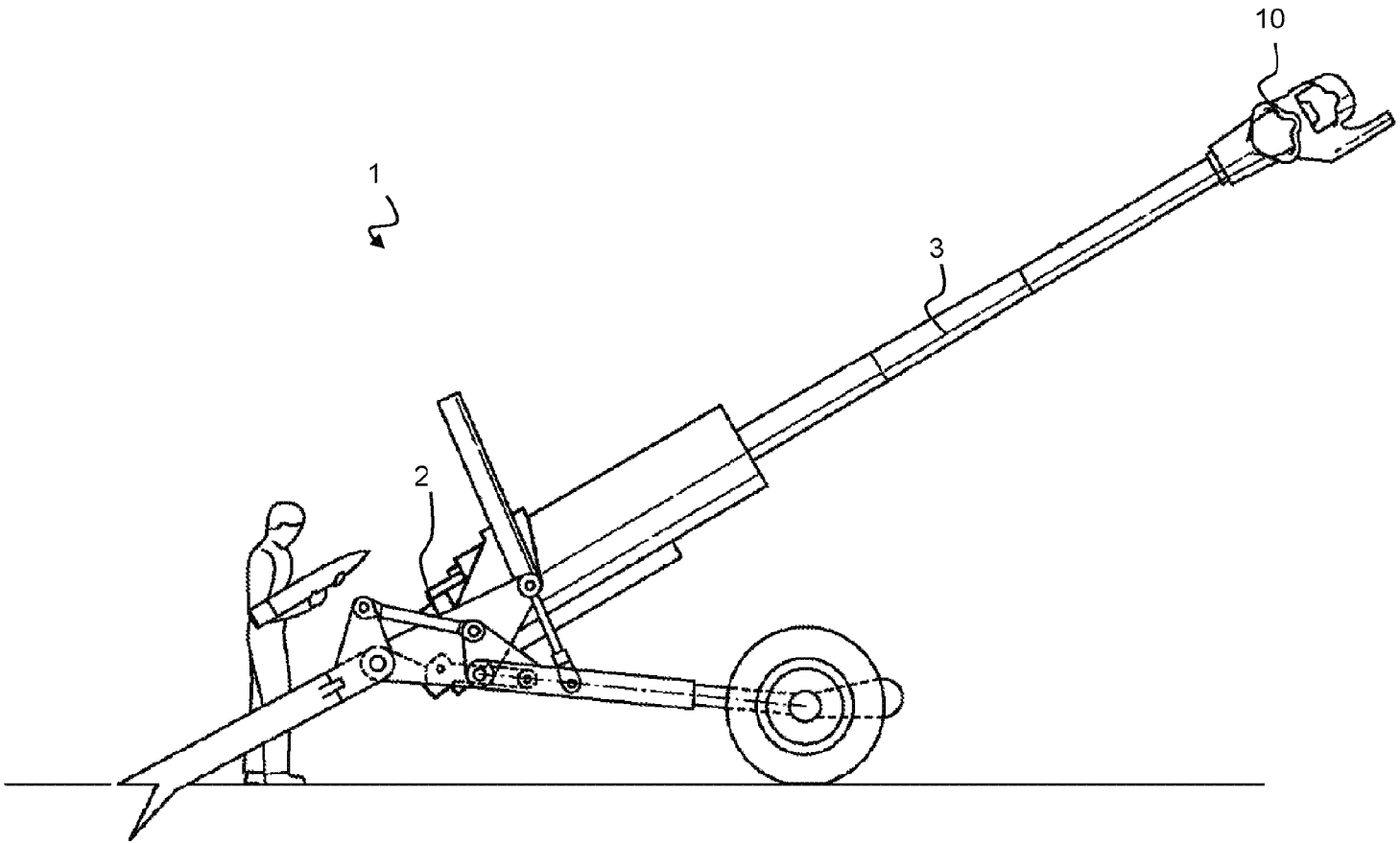
FIG. 1 is a schematic side view of an artillery weapon comprising a modular muzzle brake assembly according to an embodiment of the present invention.
Figure 2:
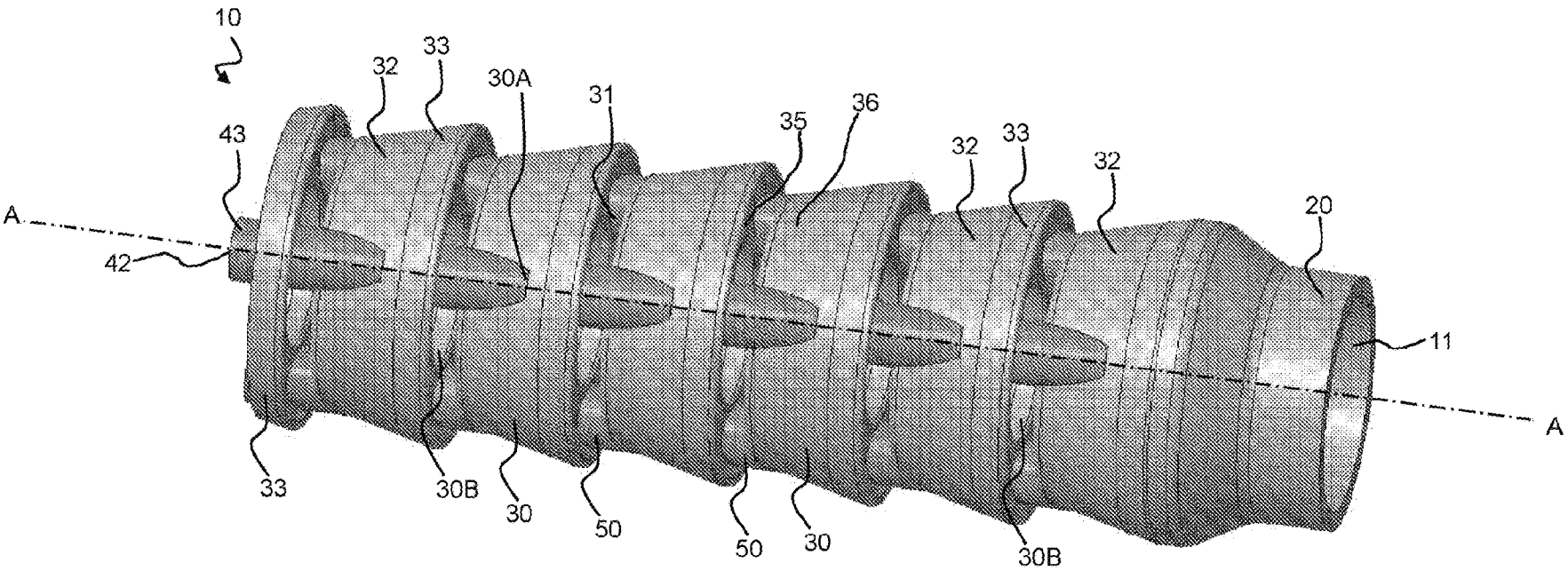
FIG. 2 is a schematic perspective view of the modular muzzle brake assembly of FIG. 1.
Figure 3:
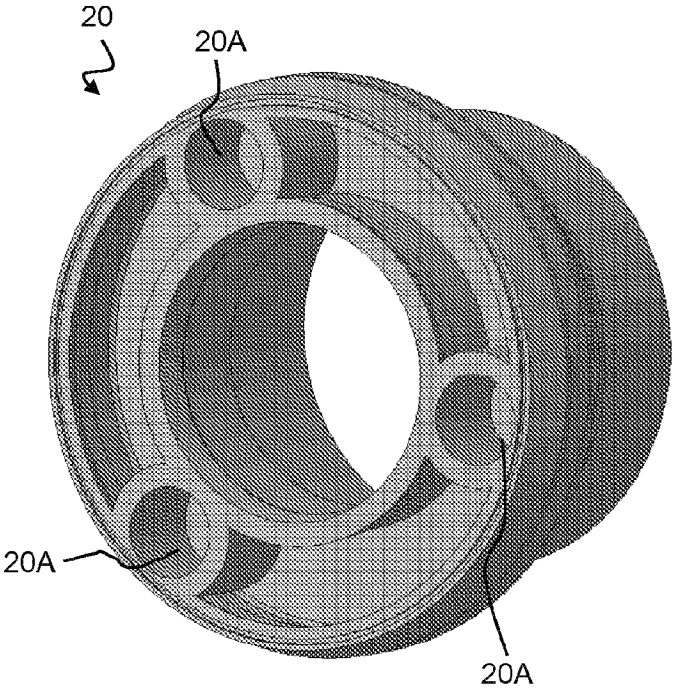
FIG. 3 is a schematic perspective view of a mounting portion of the modular muzzle brake assembly of FIG. 1.
Figure 5:
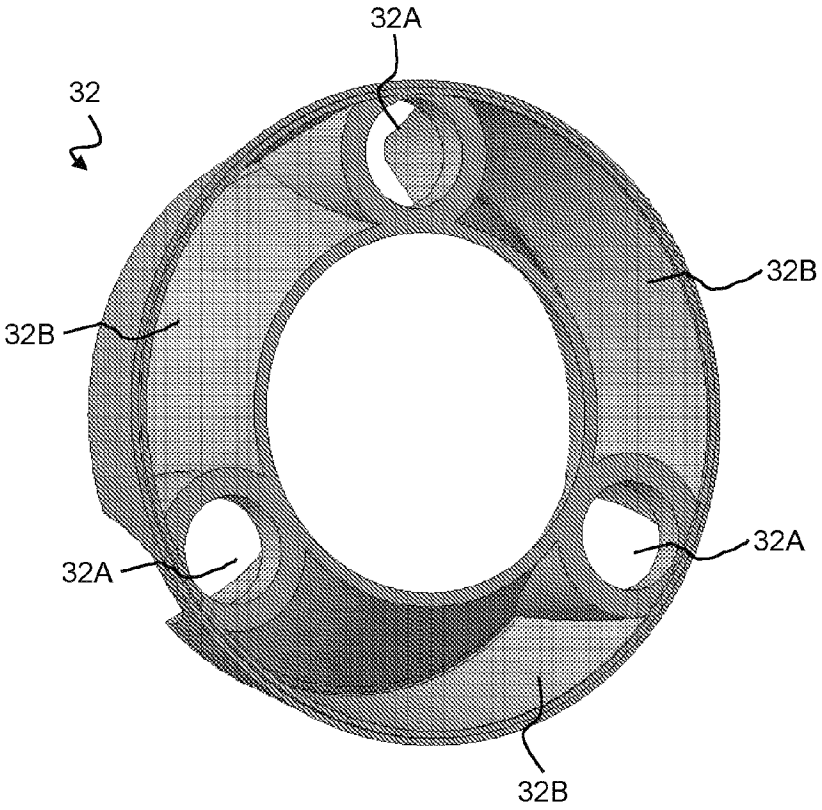
FIG. 5 is a second schematic perspective view of the first baffle member of the modular muzzle brake assembly of FIG. 1
Figure 4:
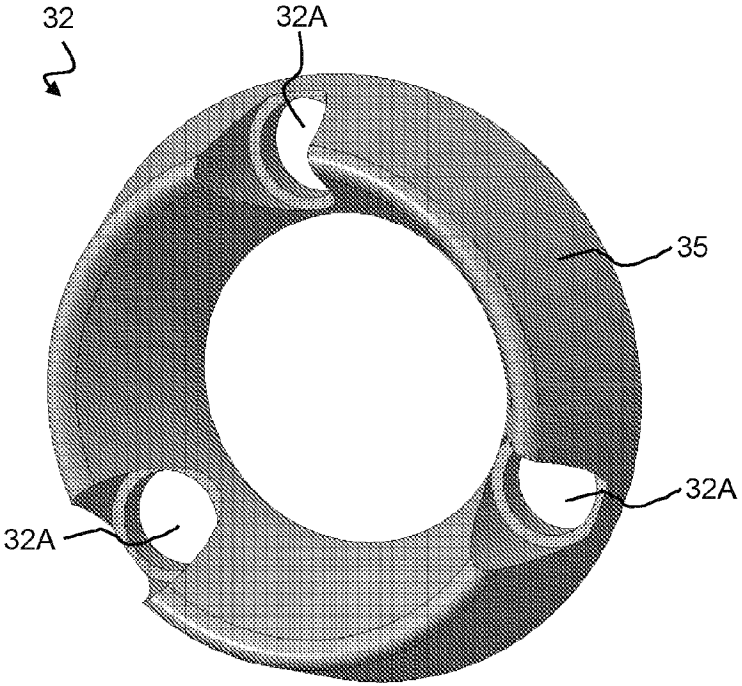
FIG. 4 is a first schematic perspective view of a first baffle member of the modular muzzle brake assembly of FIG. 1.
Figure 7:
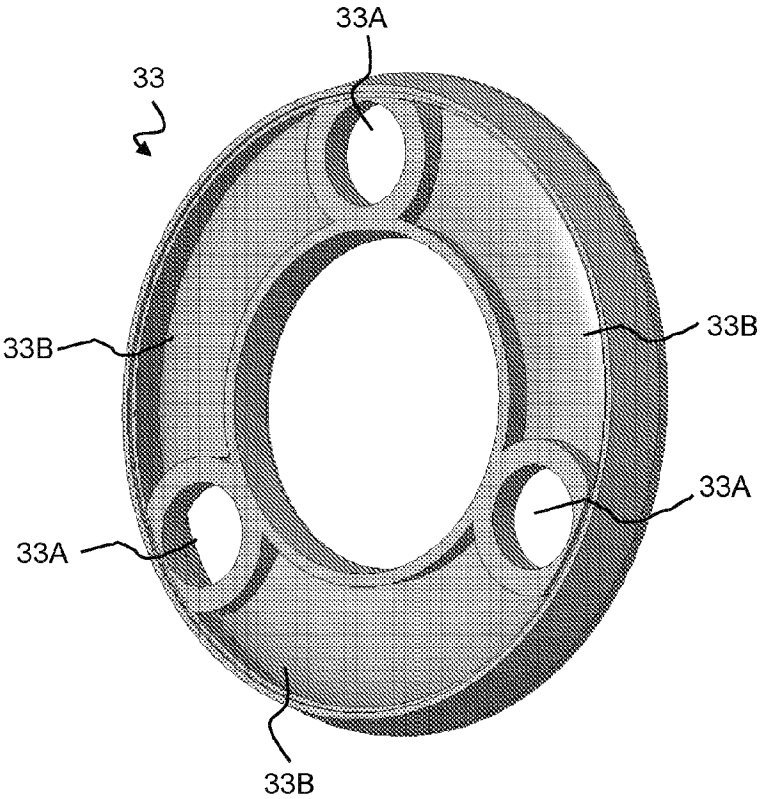
FIG. 7 is a second schematic perspective view of the second baffle member of the modular muzzle brake assembly of FIG. 1.
Figure 6:
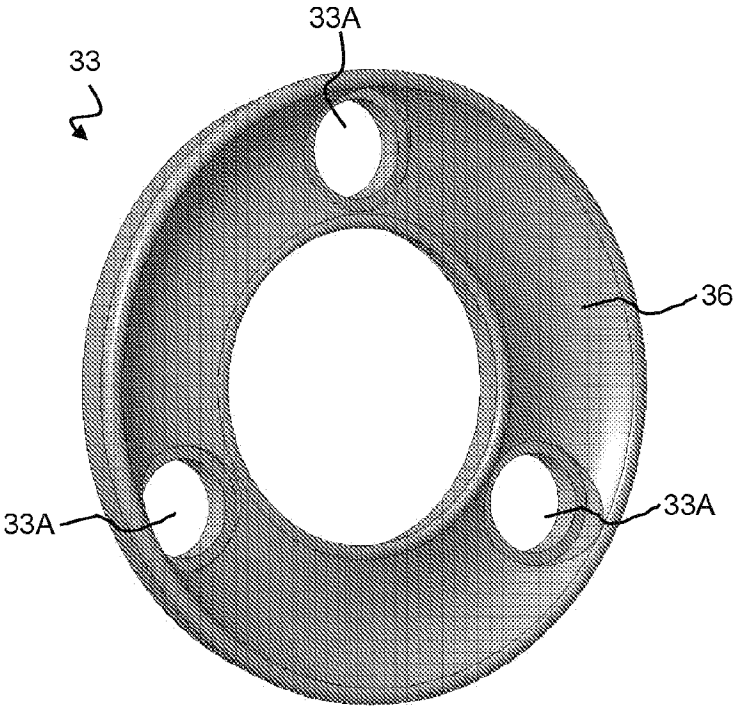
FIG. 6 is a first schematic perspective view of a second baffle member of the modular muzzle brake assembly of FIG. 1.
Figure 9:
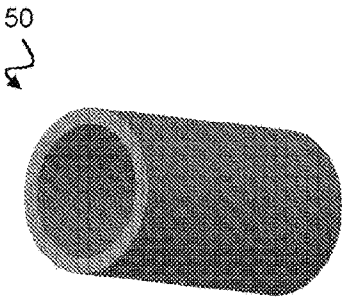
FIG. 9 is a schematic perspective view of a spacer of the modular muzzle brake assembly of FIG. 1.
Figure 8:
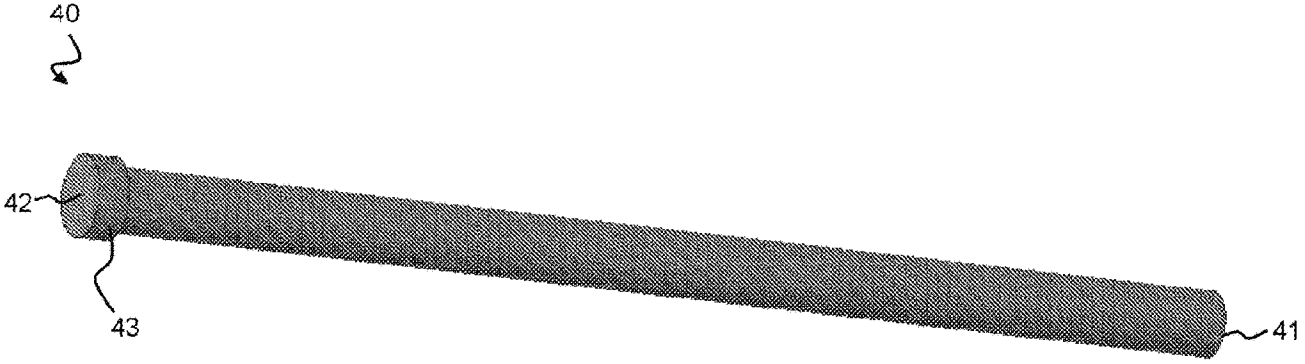
FIG. 8 is a schematic perspective view of a coupling member of the modular muzzle brake assembly of FIG. 1.
Figure 10:
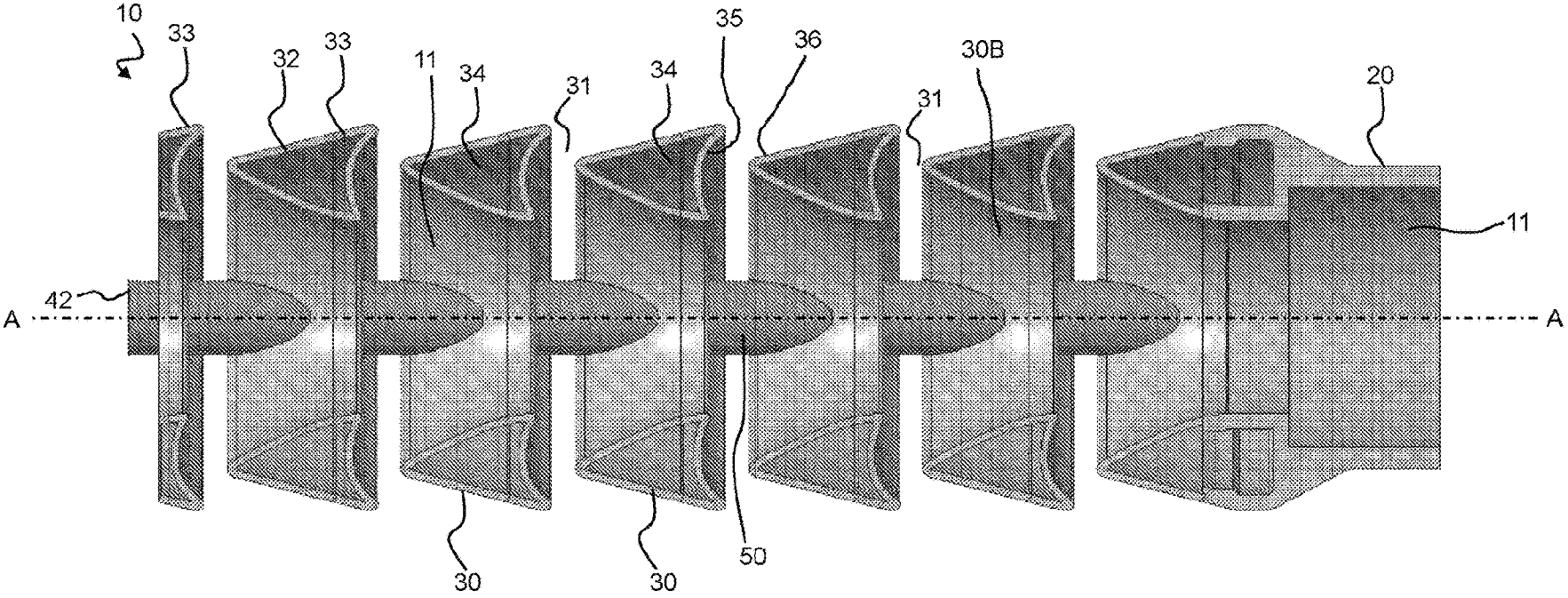
FIG. 10 is a schematic cross-sectional side view of the muzzle brake assembly of FIG. 1; and, FIG. 11 is a schematic cross-sectional side view of a modular muzzle brake assembly according to another embodiment of the invention.

Referring now to FIGS. 1 to 10, an embodiment of a modular muzzle brake assembly 10 for an artillery weapon or cannon is shown. The description of the embodiment of FIGS. 1 to 10 will hereinafter refer to an artillery weapon 1, but the disclosure is also applicable to a tank gun or other cannon.

The artillery weapon 1 has a gun barrel 3 that is pivotally mounted to a support structure 2. The muzzle brake assembly 10 is configured to be mounted to an end of the gun barrel 3 to divert a portion of the propellant combustion gas venting from the barrel 3 after a projectile has exited the barrel 3. Therefore, the muzzle brake assembly 10 reduces the recoil of the barrel 3 when the projectile is fired, and reduces stress on the support structure 2 to which the barrel 3 is mounted.

The modular muzzle brake assembly 10 comprises a plurality of modules 20, 30, 50 configured to be releasably coupled together to define a passage 11 for a projectile (not shown) such that, when the artillery weapon 1 is fired, propellant gas urges the projectile to pass through the passage 11. The modules 20, 30, 50 may include baffles 30. The baffles 30 may define one or more gas diverting surfaces/regions for diverting the propellant gas such that recoil is reduced.

The modularity of the muzzle brake assembly 10 means that individual modules, or groups of modules, can be swapped out of or rearranged in the muzzle brake assembly 10. This is advantageous because it has been found that baffles 30 within the muzzle brake assembly 10 will tend to wear at different rates. For example, baffles 30 located nearest to the end of the gun barrel 3 will tend to wear the quickest, coming into contact with the greatest amount of high velocity propellant combustion gas that is venting from the gun barrel 3, whereas baffles 30 located further away from the end of the gun barrel 3 will generally wear at a slower rate, because a proportion of the propellant gas will already have been diverted by baffles 30 closer to the gun barrel 3 and thus will not come into contact with the further away baffles 30. The temperature of the propellant gas will also decrease as the propellant gas travels away from the end of the gun barrel 3.

The modular muzzle brake assembly 10 therefore allows for the modules subjected to higher wear to be replaced and/or maintained, whilst retaining the lower wear modules within the muzzle brake assembly 10 that do not yet need to be replaced and/or maintained. This is advantageous because it is easier to store and transport replacement modules rather than entire muzzle brake assemblies. Also, repair of the modular muzzle brake assembly 10 by replacing the worn modules is less expensive and more environmentally friendly than replacing the entire muzzle brake assembly 10. Furthermore, the order of the modules within the muzzle brake assembly 10 may be changed to achieve a more even wear of the modules.

Optionally, the modularity of the muzzle brake assembly 10 also allows for the performance of the muzzle brake assembly 10 to be adjusted or tuned. This is advantageous because it means that the efficiency of the muzzle brake assembly 10 can be adjusted, for example, based on one or more of: the type of projectile that is to be fired; environmental conditions; and/or, whether the artillery weapon 1 is being used under training conditions or in conflict.

As is explained in more detail below, one or more of the baffles 30 may be swapped for baffle(s) 30 that are configured to divert the propellant gas in a more efficient or less efficient manner. Alternatively, or additionally, the efficiency of the modular muzzle brake assembly 10 can be adjusted by adjusting one or more of: the number of baffles 30 in the assembly 10; the spacing between adjacent baffles 30; the orientation of one or more of the baffles 30; and/or, the order of the baffles 30 within the muzzle brake assembly 10.

The muzzle brake assembly 10 comprises a mounting portion 20 that is configured to be mounted to the end of the barrel 3 of the artillery weapon 1. In the present example, the plurality of modules includes the mounting portion 20. The mounting portion 20 may be a mounting member 20.

The mounting portion 20 may be configured to be releasably mounted to the barrel 3, for example, being screwed on to the barrel 3 or bolted to the barrel 3. In another embodiment (not show), the mounting portion 20 is permanently fixed to the barrel 3, for example, being welded to the barrel 3 or integrally formed with the barrel 3. In some embodiments, the mounting portion 20 is provided with a screw thread that engages a screw thread on the gun barrel 3.

In the present example, the mounting portion 20 forms part of the passage 11 and the propellant gas venting from the gun barrel 3 passes through the mounting portion 20 and contacts the interior of the mounting portion 20. However, in other embodiments (not shown) the mounting portion 20 may be received on the outer circumferential surface of the gun barrel 3. Therefore, the propellant gas may substantially not come into contact with the interior of the mounting portion 20.

The plurality of modules include a plurality of baffles 30 configured to divert at least a portion of the propellant gas in the passage 11.

A gap 31 is provided between at least two baffles 30 of the assembly 10. The gap 31 forms a channel 31 such that at least a portion of the propellant gas in the passage 11 can pass through the gap 31 and thus is diverted to reduce the rearward momentum of the barrel 3 when the projectile is fired. However, it should be recognised that in other embodiments (not shown) the baffles 30 may comprise a channel within the baffle 30 itself. For example, the channel may extend radially through a wall of the baffle 30 from the passage 11 to the exterior of the baffle 30 to provide a path for a portion of the propellant gas to follow such that the gas is diverted to reduce the rearward momentum of the barrel 3 when a projectile is fired. In one such embodiment, no gap is provided between adjacent baffles 30. The adjacent baffles 30 may abut each other.

In the present example, the modules of the modular muzzle brake assembly 10 include a plurality of spacers 50. Each spacer 50 is configured to space apart adjacent baffles 30 of the assembly 10 to form the gap 31 between the adjacent baffles 30. However, it should be recognised that in other embodiments (not shown) gaps are provided between adjacent baffles 30 without the use of spacers and, for example, the baffles 30 may instead be shaped to form said gaps.

In some embodiments, at least one of the baffles 30 comprises a first baffle member 32 and a second baffle member 33. In the present example, the first and second baffle members 32, 33 are first and second baffle plates 32, 33. The first and second baffle members 32, 33 may be generally annular.

In the present example, each baffle 30 comprises a central channel 30B that forms a portion of the passage 11. Thus, when the baffles 30 are assembled within the modular muzzle brake assembly 10, the channels 30B are aligned to form at least a portion of the length of the passage 11.

In the present example, each baffle 30 is generally frustoconical in shape. However, it should be recognised that a wide variety of shapes of each baffle 30 are possible, and the shape of the or each baffle 30 may be selected to achieve particular flow conditions (e.g. pressure, velocity or direction of flow) of the propellant gas being diverted by the baffles 30. The baffles 30 may all have the same shape or different baffles 30 within the assembly 10 may have different shapes.

In other embodiments (not shown), the baffles 30 are each formed from a single component.

The first and second baffle members 32, 33 are configured to be coupled together to form a respective baffle 30. The or each baffle 30 may have a hollow structure to allow for a weight saving in comparison to solid baffles 30. In the present example, a space 34 is disposed between the first and second baffle members 32, 33 when the first and second baffle members 32, 33 are coupled together. One or each of the first and second baffle members 32, 33 has one or more depressions or grooves 32B, 33B that form at least part of the space 34 of the baffle 30. In the present example, the first baffle member 32 has a plurality of grooves 32B and the second baffle member 33 has a plurality of grooves 33B. The grooves 32B, 33B of adjacent first and second baffle members 32, 33 together form a space 34 of the baffle 30. Manufacturing the baffles 30 from first and second members 32, 33 makes it easier to provide the space 34 within each baffle 30.

The first baffle member 32 comprises a first flow control surface 35 and the second baffle member 33 comprises a second flow control surface 36. Propellant gas flowing out of the passage 11 via the gap 31 between baffles 30 impinges on the flow control surfaces 35, 36 and is directed in such a manner to retard the recoil of the barrel 3. For example, at least a portion of the propellant gas may be diverted in a direction away from the fired projectile in order to oppose the rearward recoil motion of the barrel 3 when the projectile is fired.

In some embodiments, the first and second flow control surfaces 35, 36 converge (e.g. in a direction away from the passage 11) such that the cross-sectional area of the gap 31 reduces, thereby reducing the velocity and increasing the temperature of propellant gas entering the gap 31 from the passage 11. The first and second flow control surfaces 35, 36 may then diverge (e.g. in a direction away from the passage 11) such that the cross-sectional area of the gap 31 increases, thereby increasing the velocity of the propellant gas as it exits the gap 31. This increase in the velocity of the propellant gas as it exits the gap 31 will increase the rearward momentum of the propellant gas and therefore increase the braking force of the muzzle brake assembly 10 to mitigate recoil.

The muzzle brake assembly 10 further comprises at least one coupling member 40 to couple the modules together. In some embodiments, at least one, or a plurality, of the modules are releasable from the at least one coupling member 40.

In the present example, each coupling member 40 comprises an elongate member 40 that extends in a direction substantially parallel to the central axis A-A of the passage 11 of the muzzle brake assembly 10.

The spacers 50 may each comprise a tubular spacer 50 that is configured to receive a portion of a coupling member 40. The spacers 50 may be configured to space apart a first baffling member 32 (e.g. of a first one of the baffles 30) from a second baffling member 33 (e.g. of a second one of the baffles 30) to form the gap 31 therebetween.

All of the modules can be coupled to a common coupling member 40. However, in other embodiments (not shown), the or each coupling member 40 may have an alternative form, for example, one or more bolts or other fasteners that are configured to couple adjacent modules together. In one embodiment (not shown), each module has a screw thread or bayonet connection that is configured to couple to a screw thread or bayonet connection of an adjacent module. However, it has been found that providing a common coupling member that couples multiple modules together makes it quicker to assemble the muzzle brake assembly.

In the present example, the or each elongate member 40 is in the form of a tie rod 40.

The or each baffle 30 comprises a receiving portion 30A that is configured to receive a respective coupling member 40. In the present example, each first baffle member 32 comprises one or more receiving portions 32A and each second baffle member 33 comprises one or more receiving portions 33A. The or each receiving portion 32A of a first baffle member 32 is aligned with a respective receiving portion 33A of an adjacent second baffle member 33 such that aligned receiving portions 32A, 33A together form a receiving portion 30A of the baffle 30.

In the present example, each receiving member 32A, 33A is an aperture through the respective baffle member 32, 33. It should be recognised that in some embodiments (not shown), one or more of the receiving members 32A, 33A may be a slot in the respective baffle member 32, 33. In some embodiments (not shown), one or more of the receiving members 32A, 33A may be a cut-out that extends into the radially inner or outer edge or surface of the respective baffle member 32, 33

In the present example, the muzzle brake assembly 10 comprise three coupling members 40. However, it should be recognised that in other embodiments (not shown) the muzzle brake assembly may comprise a different number of coupling members, for example, one, two, four, or six coupling members. In embodiments comprising a single coupling member, the coupling member may have a non-circular cross section in order to prevent rotation of the baffles relative to the coupling member.

In the present example, each baffle 30 comprises three receiving portions 30A, each configured to receive a part of a respective coupling member 40. That is, each first baffle member 32 comprises three receiving portions 32A and each second baffle member 33 comprises three receiving portions 33A that are each aligned with a respective receiving portion 32A of an adjacent first baffle member 32.

Each coupling member 40 has first and second ends 41, 42. A first end 41 of the coupling member 40 is configured to be attached to the mounting portion 20. In the present example, the first end 41 of each coupling member 40 comprises a thread (not shown) that is configured to be coupled to a threaded receiving portion 20A of the mounting portion 20. However, it should be recognised that in other embodiments (not shown) the coupling members 40 are permanently attached to the mounting portion 20, for example, by welding or being integrally formed therewith, or are releasably attached to the mounting portion 20 by a bayonet connection or other releasable mechanism.

Each coupling member 40 comprises a stop 43. In the present example, each stop 43 is provided at the second end 42 of the coupling member 40.

Each stop 43 is configured to retain the modules on the respective coupling member 40. That is, the stop 43 has a larger size than the receiving portions 32A, 33A of the baffle members 32, 33 such that the baffle members 32, 33 are prevented from passing the stops 43 of the coupling members 40.

In the present example, each stop 43 is a flanged end of the coupling member 40. However, in other embodiments (not shown), the or each stop 43 may have a different form, for example, comprising a bolt that engages a thread at the second end 42 of each coupling member 40.

In another embodiment (not shown), each coupling member 40 is attached to a common stop, which may be annular. The coupling members 40 may be releasably attached to the common stop. Alternatively, the coupling members 40 may be permanently attached to the common stop, in which case the coupling members 40 may be releasably coupled to the mounting portion 20 to allow for decoupling of the modules from the coupling members 40.

The modular muzzle brake assembly 10 may be supplied pre-assembled or may be supplied as a kit of parts configured to be assembled to form the modular muzzle brake assembly 10. The kit of parts may optionally comprise additional modules (for example, baffles 30 and/or spacers 50) that can be substituted when modules of the assembly wear. The kit of parts may optionally comprise different types of baffles 30 that allow for adjustment of the muzzle brake efficiency, as described in more detail below.

An example of one method of assembly of the muzzle brake assembly 10 will now be described. In this particular example, a second baffle member 33 is slid on to the three coupling members 40 until said second baffle member 33 contacts the respective stops 43 of the coupling members 40. Next, a spacer 50 is slid on to each of the coupling members 40, and then a first baffle member 32 and an additional second baffle member 33 are slid on to the coupling members 40 (in that order) until each spacer 50 contacts the second baffle member 33 already coupled to the coupling members 40, the first baffle member 32 contacts the spacers 50, and the additional second baffle member 33 contacts the first baffle member 32 such that the first baffle member 32 and additional second baffle member 33 together form a baffle 30. The process of sliding the spacers 50, first baffle member 32 and second baffle member 33 (in that order) on to the coupling members 40 is then repeated (in this example, a further four times). A further three spacers 50 and then a first baffle member 32 are then slid on to the coupling members 40, and the first end 41 of each coupling member 40 is then attached to the mounting portion 20 such that the modules (e.g. the baffles 30 and spacers 50) are held between the mounting portion 20 and stops 43. In some embodiments, each stop 43 is configured to be engaged by a socket or wrench and, for example, may have a hexagonal shape.

In an alternative embodiment, the coupling members 40 are first attached to the mounting portion 20, the modules are then slid on to the coupling members 40, and then the stops 43 are attached to the coupling members 40 to retain the modules in position on the coupling members 40.

As explained above, the modularity of the muzzle brake assembly 10 means that individual modules, or groups of modules, can be swapped out of the muzzle brake assembly 10. This is advantageous because it is easier to store and transport replacement modules rather than entire muzzle brake assemblies. Also, repair of the muzzle brake assembly 10 by replacing the worn modules is less expensive and more environmentally friendly than replacing the entire muzzle brake assembly 10. The order of the modules within the muzzle brake assembly 10 may be changed to achieve a more even wear of the modules. For example, a module in a higher wear position (e.g. closer to the gun barrel 3) can be swapped for a module in a lower wear position (e.g. further away from the gun barrel 3).

Optionally, the modularity of the muzzle brake assembly 10 allows for the performance of the muzzle brake assembly 10 to be adjusted or tuned. In one such embodiment, the efficiency of the muzzle brake assembly 10 may be adjusted. For example, one or more of the baffles 30 may be replaced with baffle(s) that are configured to divert the propellant gas in a more efficient manner, for example, diverting a greater volume of propellant gas and/or at a greater angle of diversion to increase the recoil efficiency of the muzzle brake assembly 10. This means that the efficiency of the muzzle brake assembly 10 can be adjusted, for example, based on one or more of: the type of projectile that is to be fired; environmental conditions; and/or, whether the artillery weapon 1 is being used under training conditions or in conflict.

In another embodiment, the efficiency of the modular muzzle brake assembly 10 can be adjusted by adjusting the number of baffles 30 in the muzzle brake assembly 10. Increasing the number of baffles 30 will increase the efficiency of the muzzle brake assembly 10, whereas reducing the number of baffles 30 reduces the efficiency but makes the muzzle brake assembly 10 more lightweight. The length of the muzzle brake assembly 10 can therefore be adjusted.

In another embodiment, the efficiency of the modular muzzle brake assembly 10 can be adjusted by adjusting the spacing between adjacent baffles 30 in the muzzle brake assembly 10, for example, by adjusting the length and/or number of spacers 50 between adjacent baffles 30. In another embodiment, the efficiency of the modular brake assembly 10 can be adjusted by adjusting the orientation of one or more of the baffles 30. For example, the efficiency of the baffles 30 may be controlled by adjusting whether the baffles 30 face in a first direction (e.g. with a first end of the baffles 30 facing towards the gun barrel 3) or in a second direction (e.g. with the first end of the baffles 30 facing away from the gun barrel 3).

In another embodiment, the efficiency of the modular muzzle brake assembly 10 can be adjusted by adjusting the order of the baffles 30 within the muzzle brake assembly 10. For instance, one or more of the baffles 30 may be configured to divert the propellant gas in a more efficient manner than at least one other of the baffles 30, for example, diverting a greater volume of propellant gas and/or diverting the gas at a greater angle of diversion. The more efficient baffle(s) 30 can be provided within the assembly 10 such that the baffle(s) are closer to the gun barrel 3, which will increase the recoil efficiency of the muzzle brake assembly 10. Conversely, the less efficient baffles(s) 30 can be provided within the assembly 10 such that the baffle(s) are closer to the gun barrel 3, with the more efficient baffle(s) 30 located further away from the gun barrel 3, which will decrease the recoil efficiency of the muzzle brake assembly 10.

Figure 11:
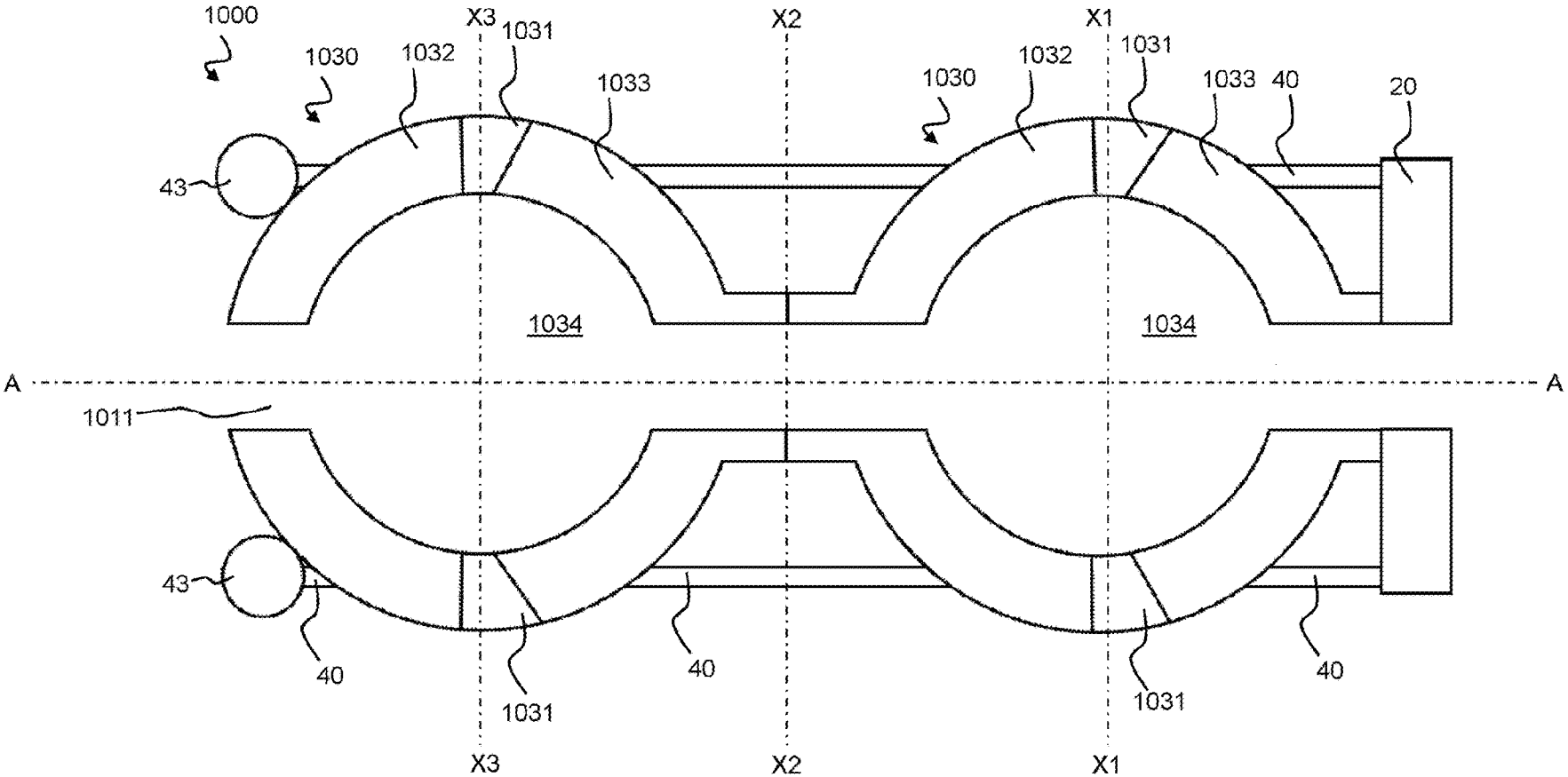

Referring to FIG. 11, another embodiment of a modular muzzle brake assembly 1000 for an artillery weapon or cannon is shown. The assembly 1000 is configured to be mounted to the end of a gun barrel (not shown). The modular muzzle brake assembly 1000 of FIG. 11 is assembled in a similar manner to the modular muzzle brake assembly 10 of FIGS. 1 to 10, and therefore a detailed explanation will not be repeated hereinafter, and like features retain the same reference numerals.

The modular muzzle brake assembly 1000 comprises a plurality of modules 1030 configured to be releasably coupled together to define a passage 1011 for a projectile such that, when the artillery weapon or cannon is fired, propellant gas urges the projectile to pass through the passage 1011. The plurality of modules include a plurality of baffles 1030 configured to divert at least a portion of the propellant gas in the passage 1011.

Each baffle 1030 comprises first and second baffle members 1032, 1033. The first and second baffle members 1032, 1033 are configured to form a chamber 1034 therebetween for receiving propellant gas. The chambers 1034 of the baffles 1030 together at least partially form the passage 1011 for the projectile. In some embodiments, propellant gas exiting the gun barrel (not shown) is able to expand within the chambers 1034.

Each baffle 1030 further comprises a channel 1031 configured to divert a portion of propellant gas in the chambers 1034 out of the chambers 1034 in a manner to reduce the rearward momentum of the gun barrel (not shown) and thus mitigate recoil. In the present example, the channels 1031 are formed between respective first and second baffle members 1032, 1033.

In some embodiments, the first and second baffle members 1032, 1033 comprise substantially hemispherical portions that abut to form a generally spherical region that defines the chamber 1034.

In the present example, adjacent baffles 1030 of the assembly 1000 are held in an abutting relationship such that no gaps are provided therebetween.

The second baffle member 1033 of the baffle 1030 nearest to the mounting portion 20 is held against the mounting portion 20, and the first baffle member 1032 of the same baffle 1030 is held against said second baffle member 1033 along the line X1-X1 in FIG. 11. The aforementioned first baffle member 1032 is held against the second baffle member 1033 of an adjacent baffle 1030 along the line X2-X2 in FIG. 11. The second baffle member 1033 of said adjacent baffle 1030 is held against the first baffle member 1032 of the same baffle 1030 along the line X3-X3 in FIG. 11.

The muzzle brake assembly 1000 further comprises at least one coupling member 40 to couple the modules together. In some embodiments, at least some of the modules are releasable from the at least one coupling member 40. In the present example, each coupling member 40 comprises an elongate member 40 (e.g. a tie rod) that extends in a direction substantially parallel to the central axis A-A of the passage 1011 of the muzzle brake assembly 1000. A stop 43 is provided at the end of each coupling member 40 such that the modules (e.g. the baffles 1030) are releasably held between the stops 43 and the mounting portion 20 that attaches to the gun barrel.

In the present example, the baffles 1030 and/or baffle members 1032, 1033 can be interchanged to swap the order of the baffles 1030 and/or baffle members 1032, 1033. For instance, the first baffle member 1032 can be swapped with the second baffle member 1033 of the same baffle 1030 or of an adjacent baffle 1030, which will vary the efficiency of the muzzle brake assembly 1000. Individual baffle members 1032, 1033 and/or the entire baffle 1030 can be swapped out with replacement baffle members 1032, 1033 and/or replacement entire baffles 1030.

In some embodiments, the modular muzzle brake assembly 10, 1000 is for an artillery weapon or cannon having a calibre of at least 20 mm and, preferably, at least 76 mm.

In some embodiments (not shown), the muzzle brake assembly 10, 1000 comprises a tow pintle (not shown) configured to couple to a vehicle to facilitate towing of the artillery weapon or cannon. In some embodiments (not shown), the tow pintle extends from the baffle and/or baffle member that is furthest from the gun barrel. In other embodiments, the tow pintle extends from the mounting portion of the muzzle brake assembly.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A modular muzzle brake assembly for an artillery weapon or cannon, the modular muzzle brake assembly comprising a plurality of modules configured to be releasably coupled together to define a passage for a projectile such that, when the artillery weapon or cannon is fired, propellant gas urges the projectile to pass through the passage, and wherein the plurality of modules include a plurality of baffles configured to divert at least a portion of the propellant gas in the passage;

wherein a gap is provided between at least two of the baffles such that at least a portion of the propellant gas in the passage can pass through the gap;

wherein at least one of the baffles includes a first baffle member and a second baffle member, the first baffle member having a first flow control surface and the second baffle member having a second flow control surface; and wherein the propellant gas flowing out of the passage via the gap impinges on the first and second flow control surfaces.

2. The modular muzzle brake assembly according to claim 1, further comprising at least one coupling member to couple the modules together, the modules being releasable from the at least one coupling member.

3. The modular muzzle brake assembly according to claim 2, wherein the at least one coupling member comprises an elongate member.

4. The modular muzzle brake assembly according to claim 2, wherein one or more of the baffles comprises a receiving portion configured to receive part of the coupling member.

5. The modular muzzle brake assembly according to claim 2, wherein the at least one coupling member comprises a tie rod.

6. The modular muzzle brake assembly according to claim 1, comprising a plurality of coupling members to releasable couple the modules together.

7. The modular muzzle brake assembly according to claim 6, wherein the plurality of coupling members are configured to be disposed about a central axis of the passage.

8. The modular muzzle brake assembly according to claim 7, wherein the first and second flow control surfaces converge such that a cross-sectional area of the gap reduces about the central axis of the passage and then diverge such that the cross-sectional area of the gap increases about the central axis of the passage.

9. The modular muzzle brake assembly according to claim 1, comprising one or more spacers configured to space the-at least two of the baffles apart.

10. The modular muzzle brake assembly according to claim 9, wherein the plurality of modules includes the one or more spacers.

11. The modular muzzle brake assembly according to claim 1, wherein a space is disposed between the first and second baffle members.

12. The modular muzzle brake assembly according to claim 1, wherein the at least two of the baffles are interchangeable within the muzzle brake assembly.

13. The modular muzzle brake assembly according to claim 1, wherein the at least one of the baffles is configured to divert the propellant gas in a different manner to another one of the baffles.

14. The modular muzzle brake assembly according to claim 1, wherein the length of the passage is adjustable by altering the number of modules of the modular muzzle brake assembly.

15. The modular muzzle brake assembly according to claim 1, comprising a mounting portion configured to couple to a gun tube of the artillery weapon or cannon.

16. The modular muzzle brake assembly according to claim 1, wherein the first and second baffle members are baffle plates.

17. A weapon system comprising the modular muzzle brake assembly according to claim 1.

18. A kit of parts for a modular muzzle brake assembly for an artillery weapon or cannon, the kit of parts comprising a plurality of modules configured to be releasably coupled together to define a passage for a projectile such that, when the artillery weapon or cannon is fired, propellant gas urges the projectile to pass through the passage, and wherein the plurality of modules include a plurality of baffles configured to divert at least a portion of the propellant gas in the passage;

wherein a gap is provided between at least two of the baffles such that at least a portion of the propellant gas in the passage can pass through the gap;

wherein at least one of the baffles includes a first baffle member and a second baffle member, the first baffle member having a first flow control surface and the second baffle member having a second flow control surface; and wherein the propellant gas flowing out of the passage via the gap impinges on the first and second flow control surfaces.

19. A modular muzzle brake assembly for an artillery weapon or cannon, the modular muzzle brake assembly comprising:

a plurality of modules configured to be releasably coupled together to define a passage for a projectile such that, when the artillery weapon or cannon is fired, propellant gas urges the projectile to pass through the passage, and wherein the plurality of modules include a plurality of baffles configured to divert at least a portion of the propellant gas in the passage;

at least one coupling member to couple the modules together, the modules being releasable from the at least one coupling member; and a mounting portion configured to couple to a gun tube of the artillery weapon or cannon;

wherein one or more of the baffles comprises a receiving portion configured to receive part of the at least one coupling member;

wherein a gap is provided between at least two baffles of the assembly such that at least a portion of the propellant gas in the passage can pass through the gap;

wherein at least one of the baffles comprises first and second baffle members, and a space is disposed between the first and second baffle members, so as to provide the at least one baffle with a hollow structure;

wherein the length of the passage is adjustable by altering the number of modules of the modular muzzle brake assembly;

wherein at least two of the baffles are interchangeable within the muzzle brake assembly;

wherein diversion of the propellant gas along the passage is adjustable by altering a baffle type of one or more of the baffles relative to one or more other of the baffles;

wherein the first baffle member has a first flow control surface and the second baffle member has a second flow control surface, and wherein the propellant gas flowing out of the passage via the gap impinges on the first and second flow control surfaces.

20. The modular muzzle brake assembly according to claim 19, wherein the first and second flow control surfaces converge such that a cross-sectional area of the gap reduces about a central axis of the passage and then diverge such that the cross-sectional area of the gap increases about the central axis of the passage.

* * * * *